United States Patent [19]

Price

[11] 4,169,539

[45] Oct. 2, 1979

[54] CARTON AND LINER WITH INTEGRAL HANDLE

[75] Inventor: Jerry D. Price, Indianapolis, Ind.

[73] Assignee: Eli Lilly and Company, Indianapolis, Ind.

[21] Appl. No.: 953,156

[22] Filed: Oct. 20, 1978

[51] Int. Cl.[2] ..... B65D 5/46; B65D 5/56

[52] U.S. Cl. ..... 220/410; 222/183; 229/38; 229/52 B

[58] Field of Search ..... 220/410, 416, 441; 229/52 B, 23 BT, 38; 222/183, 465

[56] References Cited

U.S. PATENT DOCUMENTS

| | | | |
|---|---|---|---|
| 3,014,637 | 12/1961 | Wilson | 220/416 X |
| 3,054,549 | 9/1962 | Humphrey | 220/410 |
| 3,119,544 | 1/1964 | Cope et al. | 220/441 |
| 3,143,275 | 8/1964 | Diggs | 229/52 B |
| 3,522,904 | 8/1970 | Locke et al. | 229/52 B X |
| 3,788,538 | 1/1974 | Kuenzi | 229/23 R |
| 4,005,815 | 2/1977 | Nerenberg et al. | 229/52 B |

*Primary Examiner*—Allan N. Shoap

*Attorney, Agent, or Firm*—Houston L. Swenson; Arthur R. Whale

[57] ABSTRACT

A container formed from a paperboard material such as corrugated material has a liner formed of similar material and embodies an integral hand hole formed in one of the container body walls, whereby the container may be held by one hand which is completely isolated from the contents of the container.

5 Claims, 7 Drawing Figures

CARTON AND LINER WITH INTEGRAL HANDLE

BACKGROUND OF THE INVENTION

The majority of the containers having liners generally use a flexible liner formed from a material such as foil, cellophane or a wax paper. However, in some instances paper board containers require liners which are likewise formed of paper board material. Boxes of this general design are particularly attractive if the contents of the box have a tendency to build up a static attraction to liners formed from flexible material. In those instances where the containers are designed for holding granular or powder material which is to be dispensed over an area of land it is desirable to provide the container with a handle. Paper board containers and liners of the prior art have generally used handles which are independent of the paper board and are simply affixed to the container after the unit is assembled and filled. Containers with this type of handle arrangement normally require the use of two hands to incline the container and pour out the contents.

U.S. Pat. No. 3,119,544, Cope et al., discloses a carton with a hand-hold opening for dispensing the liquid contents of a bottle and does not relate to containers with liners for holding granular or powdered material. U.S. Pat. No. 4,005,815, Herenberg et al., discloses a handle formed in a carton wall but does not relate to containers having paperboard liners.

The container of this invention is formed of a paper board material having four enclosing body walls and encloses a paper board liner, likewise having four body walls and a bottom wall nestled therein. An opening is formed in a first one of the container body walls and is positioned substantially near the top of the body wall to provide access for a hand. The stiff liner that is positioned in the container has an upwardly and inwardly inclined panel adjacent this opening and is integrally formed with the adjacent first body wall of the liner. The top closure flap that extends from the first container body wall is folded into a position against the outer surface of the liner's inclined panel to fully seal off the inserted hand from the contents of the container. On the container's fourth wall opposite the first wall a dispensing means is provided through which material may be released from the container when it is tilted.

DESCRIPTION OF THE PREFERRED EMBODIMENT

Figure 1:
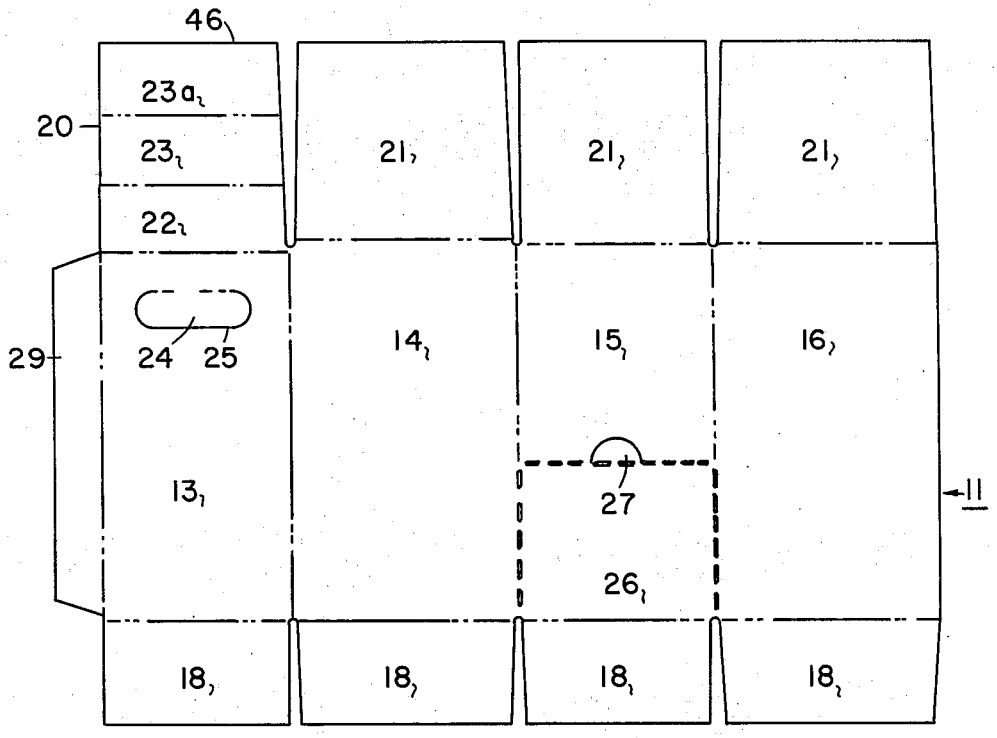
FIG. 1 is a plan view of a cut and scored blank used for forming the container.

Referring to FIG. 1, a paperboard blank 11 is illustrated which, in this preferred embodiment, is made of corrugated paperboard. The dotted lines represent scored or creased fold lines. Container blank 11 has four body walls of retangular configuration including a first wall 13, a second wall 14, and third and fourth body walls 15 and 16. The bottom enclosure comprises four end flaps 18. The top enclosure comprises four end flaps, the first of which is identified with the numeral 20, and the remaining three flaps with the numeral 21. Top end flap 20 has three crease lines dividing it into three sections, 22, 23 and **23*a*. A hinged panel 24 provides a push-in hand hole 25 in the first container wall 13. On the third wall 15 a cut-out in the form of a hinged flap 26 is provided adjacent a removable half circle cut-out 27. Flap 26 may be formed with intermittent breakaway cuts to avoid accidental extension of the flap prior to dispensing the carton's contents. Removal of cut-out 27 provides easy access to an edge of flap 26 for hinging it outwardly. A glue flap 29 is affixed to the first body wall 13 and glue may be applied to the outside surface of this section (FIG. 2**).

Figure 2:
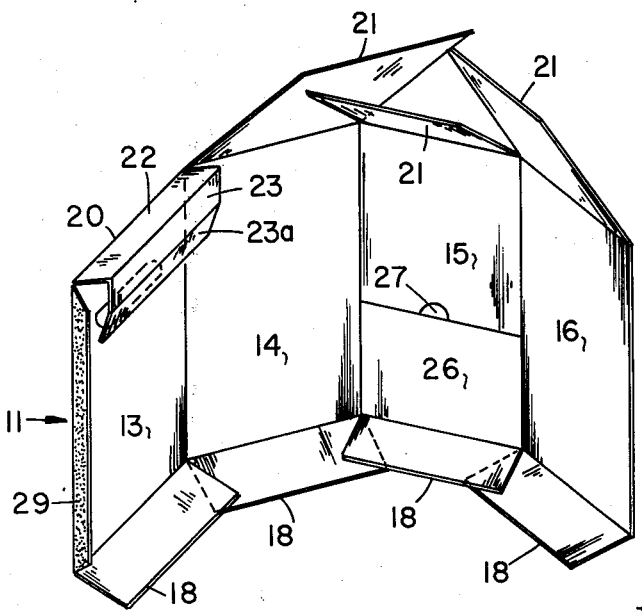
FIG. 2 is a perspective view illustrating the technique of folding the blank of FIG. 1.
Figure 5:
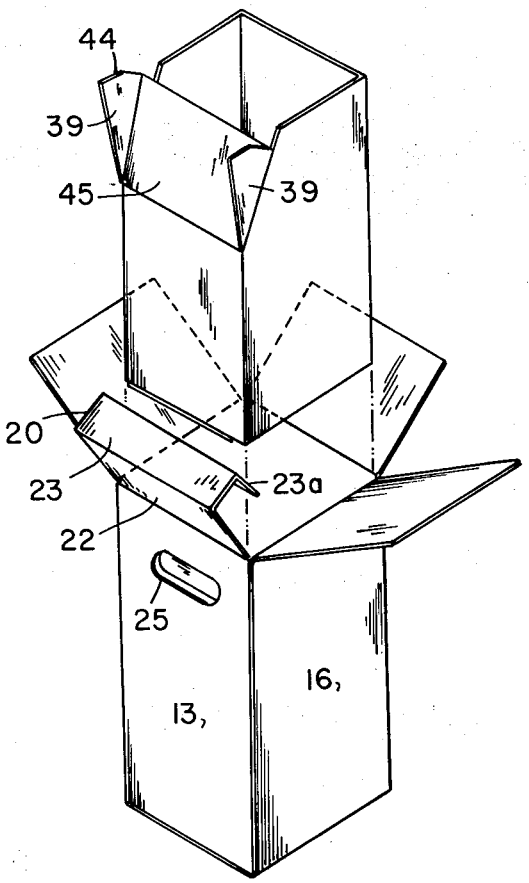
FIG. 5 is a perspective view of the assembled liner being inserted into the assembled carton.

As shown in FIG. 2, all of the crease lines are inwardly folded in assembling the outer carton. FIG. 5 illustrates the carton in its assembled form prior to closing its top closure.

Figure 3:
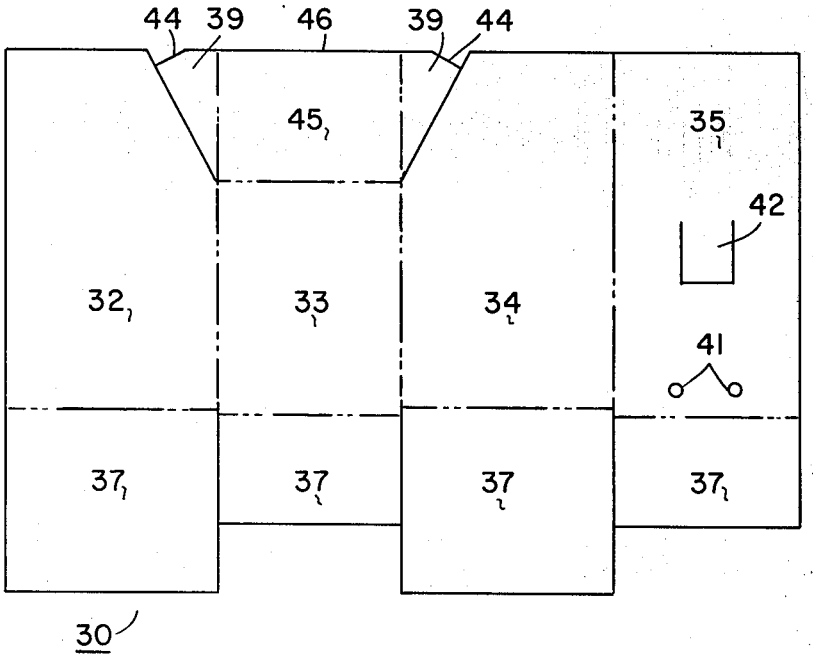
FIG. 3 is a plan view of the cut and scored blank used for forming the carton's liner.
Figure 4:
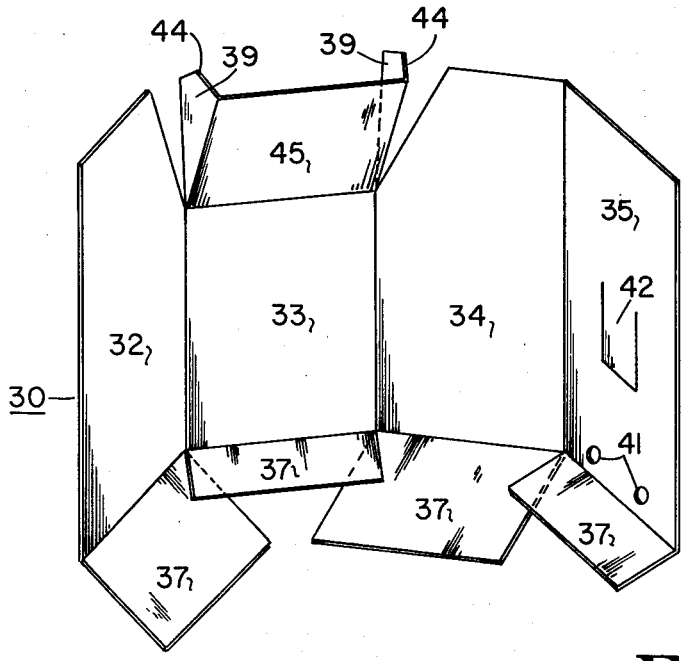
FIG. 4 is a perspective view illustrating the technique of folding this blank.

Referring to FIG. 3, a blank is illustrated which is used to form a liner 30 for the carton. First, second, third, and forth walls are identified by the numerals 32, 33, 34, and 35 respectively. The liner has a bottom closure formed by flaps 37. It is to be noted that the body walls 32 and 34 have a cut across their upper corners to form a diagonal ear 39. These two ears are foldably connected to the second body wall 33. The fourth body wall 35 has several open apertures 41 and a hinged tab 42 which is in direct alignment with knock-out portion 27 of the carton to facilitate the removal of portion 27. FIG. 4 illustrates the initial assembly steps for erecting this blank.

Figure 7:
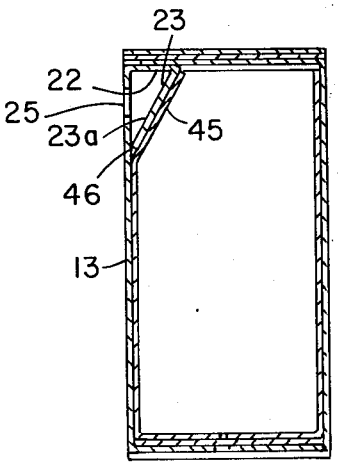
FIG. 7 is a view taken in cross section along the line 7—7 of FIG. 6.

Referring to FIG. 5, it is to be noted that the assembled liner has its pair of diagonal ears 39 folded backwardly so that they lie in the same plain as their adjacent body walls. Likewise, offset edge 44 of each of these ears is in alignment with the top edge of these body walls. As a liner is inserted snugly into the container the first closure flap 20 of the container is folded downwardly whereby it lies adjacent the inclined panel 45 which is formed as a result of bending back ears 39 of the liner. Panel 45 may have an incline of approximately 30° with the vertical. The one crease line forming section **23*a* in the top end flap 20 is used simply to facilitate the bending of this flap down into an adjacent position with respect to the inclined panel 45. It is to be noted, as shown in FIG. 7, that the outer edge 46 of section 23*a* will abut the inner surface of the first body wall 13 of the container. In this fashion the first panel section 22 of flap 20 is held in a horizontal position in the same plane as the remaining flaps of the top end closure and in adjacent contact with the opposing flap 21**.

Figure 6:
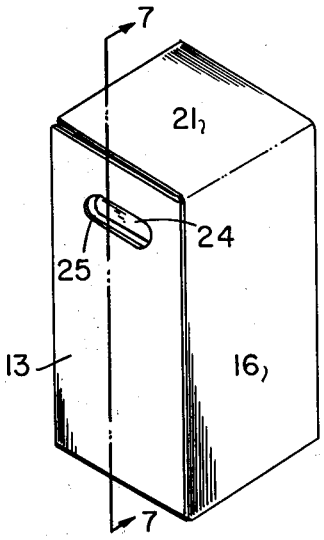
FIG. 6 is a perspective view of the assembled and closed carton and liner.

The resulting structure as shown in FIG. 6, provides a neat compact container of considerable strength with a hand hole that enables one to dispense granular or powder materials by simply inserting one hand into the hole. This particular positioning of the hand hole causes the container to tilt and remain at approximately a preferred 60 degree angle. At this angle the material in the container will flow through holes 41, and complete emptying of the container will be possible. The hand is fully isolated from the contents of the container due to the unique configuration of flap 20 which is bent downwardly against the inclined panel 45. Although only one embodiment of this invention has been disclosed it is apparent that modifications can be made without departing from the spirit of the invention.

I claim:

1. In a paperboard container having four enclosing body walls and end closures with a paperboard liner having four body walls and a bottom end closure nestled therein, the improvement of a hand hole comprising an opening formed in a first body wall of said container body walls positioned substantially near the top of said body wall, an upwardly and inwardly inclined panel adjacent said opening and forming a part of the adjacent first body wall of said liner, and a first top closure flap extending from said first body wall of said container which lies in a folded position against the outer surface of said inclined panel of said liner.

2. The improvement in accordance with claim 1 in which said first top closure flap has an initial panel area underlying and in contact with a second of said top closure flaps.

3. The improvement in accordance with claim 2 in which the end of said first top closure flap abuts the inner surface of said first container body wall.

4. The improvement in accordance with claim 3 in which the two opposing liner body walls adjacent either side of said first body wall of said liner have diagonal edges at their uppermost corners adjacent said first body wall and support said inclined panel.

5. The improvement in accordance with claim 4 in which said inclined panel has a pair of oppositely disposed ears with an edge adjacent the inner surface of said first container body wall.

* * * * *